US006006397A

United States Patent [19]

Williams et al.

[11] Patent Number: 6,006,397

[45] Date of Patent: Dec. 28, 1999

[54] BUCKET INSERT AND WASH BUCKET

[75] Inventors: Todd A. Williams, Aliso Viejo; Richard A. Williams, Dana Point, both of Calif.

[73] Assignee: S. C. Johnson Commercial Markets, Inc., Sturtevant, Wis.

[21] Appl. No.: 08/958,903

[22] Filed: Oct. 28, 1997

Related U.S. Application Data

[63] Continuation-in-part of application No. 08/865,520, May 29, 1997.

[51] Int. Cl.[6] ..... A47L 13/58

[52] U.S. Cl. ..... 15/261; 15/264; 206/514; 220/23.87; 220/731; 220/736; 220/771

[58] Field of Search ..... 206/514; 220/23.87, 220/731, 736, 771; 15/260–264

[56] References Cited

U.S. PATENT DOCUMENTS

| | | | |
|---|---|---|---|
| 884,870 | 4/1908 | Sikes | 220/731 |
| 1,246,956 | 11/1917 | Lerch | 220/23.87 |
| 2,314,835 | 3/1943 | Johns | 206/514 |
| 3,562,841 | 2/1971 | Royalty . | |
| 4,798,307 | 1/1989 | Evrard . | |
| 5,456,357 | 10/1995 | Wenner | 206/514 |
| 5,548,865 | 8/1996 | Pagani . | |
| 5,687,873 | 11/1997 | Jones | 220/736 |
| 5,813,567 | 9/1998 | Mangano | 15/264 |

FOREIGN PATENT DOCUMENTS

| | | | |
|---|---|---|---|
| 2049386 | 11/1992 | Canada | 220/731 |
| 0254507 | 1/1988 | European Pat. Off. | 15/264 |
| 2405692 | 6/1979 | France | 15/264 |
| 92212876 | 12/1992 | WIPO | 15/260 |

*Primary Examiner*—Randall E. Chin
*Attorney, Agent, or Firm*—Neil E. Hamilton

[57] ABSTRACT

The present invention provides a pliable mop bucket insert, which can be adapted to fit various buckets and wringers with different geometries. The present invention also provides a device for receiving dirty washing liquid from a mop and containing clean washing liquid for wetting a mop separately, which includes a main container for containing the clean washing liquid, an insert being removably attached to the bucket for receiving the dirty liquid, and a wringer located inside the insert and supported by the bucket. A flexible bag is further provided with the insert to contain dirty washing liquid.

13 Claims, 4 Drawing Sheets

BUCKET INSERT AND WASH BUCKET

CROSS-REFERENCE TO RELATED APPLICATION

This is a continuation-in-part application of application Ser. No. 08/865,520 filed on May 29, 1997, pending.

BACKGROUND OF THE INVENTION

The present invention relates to a bucket insert, more particularly, to a bucket insert which is adapted to fit buckets and wringers with different structures. The present invention also relates to a wash bucket having an said insert and a wringer for floor cleaning, which keeps clean wash liquid separate from dirty liquid.

In a floor cleaning process, a mop and a wash bucket are usually involved. A wringer is typically mounted to a wash bucket to wring the moisture from a wetted mop. During a cleaning process, the mop is dipped into a washing fluid contained in a bucket and is moved around the floor to remove dirt from the floor. In order to it clean, the mop needs to be wrung repeatedly with the wringer and washed by dipping it into the washing fluid. Dirty fluid squeezed out from the mop used to be returned to the clean washing fluid. Thus, the washing fluid in the bucket will be contaminated quickly.

Devices have been developed to overcome this disadvantage. U.S. Pat. No. 5,548,865 discloses a device for collecting dirty washing liquid and for containing clean liquid for wetting a floor-cloth for washing floors. The device includes a main container which supports a wringer and defines a compartment for collecting the liquid produced by wringing the floor-cloth, and a secondary container or insert which is mounted to the top portion within the main container and contains clean washing liquid for wetting the floor-cloth. Thus, the clean washing liquid is separated from the dirty liquid contained in the main container.

Although this device provides the advantage of separating the dirty fluid from the washing fluid, it suffers several drawbacks. First, because of the way the device is configured, the insert can only be fitted into certain buckets specially designed to receive the insert. Secondly, because the insert is mounted to the top portion of the bucket and is used to contain the clean washing liquid, the whole system is not very stable when first starting the cleaning as the washing liquid contained by the insert tends to raise and off-center the center of mass. Another problem is that there is no room for keeping the mop because the insert is not deep enough and it is not desirable to keep the mop in the dirty liquid of the main container.

U.S. Pat. No. 4,798,307 discloses a bucket having separate reservoirs for segregating clean washing liquid form dirty washing liquid. The bucket contains a discharge transfer compartment with holes on its bottom wall for wringing a mop and draining the dirty liquid into a discharge storage reservoir which is located beneath the discharge transfer compartment and occupies the whole lower portion of the bucket. The floors of the discharge transfer compartment and the clean liquid reservoir are shaped with adequate slope or curvature so that particulate material discharged from a mop is caused to move to the lowest point for removal. However, this bucket does not use a removable insert. In stead, a discharge transfer compartment and a discharge storage reservoir are used. Because they are mounted nonremovably and contain holes and curvatures, it is not convenient to clean the bucket.

U.S. Pat. No. 3,562,841 discloses a bucket provided with a squeeze plate for squeezing a mop of the sponge-type material. The bucket has an inner bucket for containing clean washing liquid and a separate container for receiving a filter and the dirty liquid drained through the filter. The separate container or insert has a fixed size and shape determined by the dimensions of the filter and the squeeze plate (wringer), therefore, can not be used for other types of buckets and mops.

Therefore, there is a need for a bucket with an insert and wringer, which separates dirty wash liquid from clean wash liquid and overcomes the disadvantages exist in the prior art as discussed above. Furthermore, there is a need for a bucket combination which does not require strict match in structures between the bucket and the insert.

SUMMARY OF THE INVENTION

One aspect of the present invention provides a pliable mop bucket insert which can be adapted to fit a variety of buckets and wringers with different geometric structures. In use the bucket insert is inserted into a bucket. Thus, the bucket of the present invention includes a main container (or bucket) for containing a clean washing liquid, a pliable insert being removably attached to the bucket for receiving dirty liquid, and a wringer located inside the insert and supported by the bucket.

In another aspect of the present invention, the insert is further provided with a plastic bag adapted to fit into the insert for containing dirty washing liquid.

Advantageously, the present invention also provides a method for cleaning a floor using the device provided by the present invention.

In one embodiment of the present invention, the bucket insert has a body having a front wall, a back wall, two side walls and a bottom wall. These walls define a chamber or space for accommodating a wringer and receiving dirty wash liquid from the wringer when the insert is used with a wash bucket. The insert is so configured that it is easy to be adapted for wash buckets with different shapes. For example, the walls that are in touch with bucket walls are preferably angled and/or curved, and the angles between those walls are preferably greater than 90 degree and rounded. A hook is provided on the top portion of the back wall or the side wall of the insert When mounted into a bucket, the hook helps to hold the insert inside the upper portion of the bucket. Then a wringer is mounted to the bucket over the insert in such a way that it further secures the insert in position and forces the pliable insert walls against the bucket so as to fit the insert into the structure of the bucket. Therefore, the insert according to the present invention can be used with a wide variety of buckets.

In another embodiment, the bucket insert may have similar structures and properties as described above. But a plurality of openings or holes is provided in the bucket insert. In this case, the bucket insert functions as a support for a flexible container. Preferably, a disposable plastic bag is placed into the bucket insert for containing dirty washing liquid. When the cleaning is finished, the plastic bag can be taken out of the bucket insert, the dirty washing liquid damped and the used plastic bag disposed. One advantage of this arrangement is that one does not have to clean up dirt and dirty washing. In stead, the used plastic bag is simply disposed with dirt in it.

The wash bucket device according to the present invention has relatively small dimension and can be used even within a limited space. Yet there is enough room to retain the mop in the clean washing liquid without having to hold it all the time or put it into dirty washing liquid because of the way the bucket and the insert is configured as will be discussed below.

DETAILED DESCRIPTION OF THE PREFERRED EMBODIMENT

Figure 1:
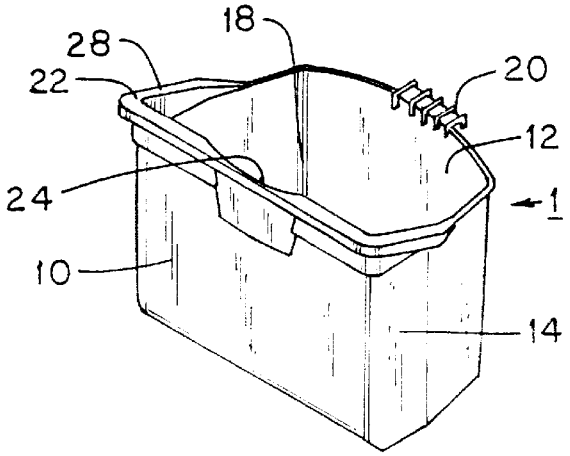
FIG. 1 is a schematic view of the insert according to the present invention.
Figure 2:
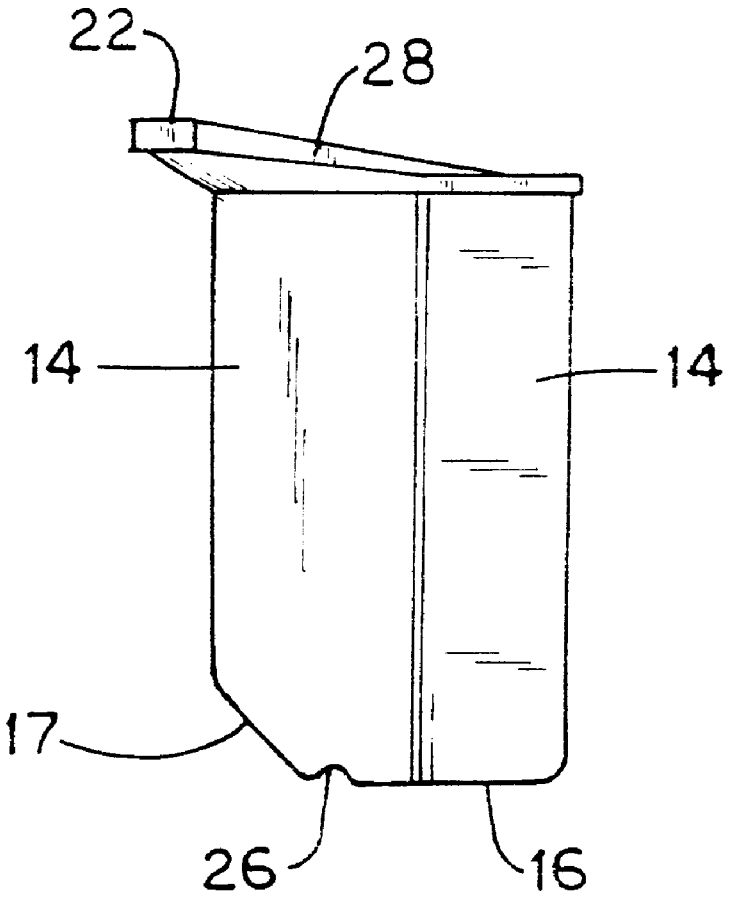
FIG. 2 is a side view of the inert shown in FIG. 1.

Referring to FIG. 1, the insert 1 has a front wall 10, a back wall 12, a side wall 14, a bottom wall 16. Those walls define a space or a chamber 18. On the upper edge of the back wall 12 is a hook 20. There is a splash guard 22 on the upper portion of the insert 1, which covers the whole upper edge of front wall 10 and part of the upper edge of side walls 14 and extends upwardly and forwardly as shown in FIG. 2. There is a spout 24 in the middle of the splash guard 22 on the upper portion of the front wall 10. The back wall 12 is slightly curved toward the front wall 10. The side walls 14 on both sides are angled toward each other as shown in FIG. 1. The bottom wall 16 is also angled upwardly near front wall 10 as sown in FIG. 2 forming a inclined surface 17. There is an indentation 26 on the bottom wall 16 (see FIG. 2).

Figure 3:
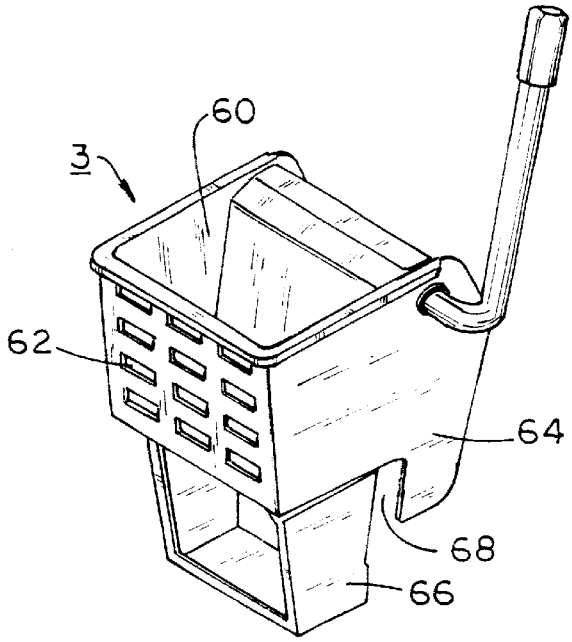
FIG. 3 is a schematic view of the wringer according to the present invention.
Figure 4:
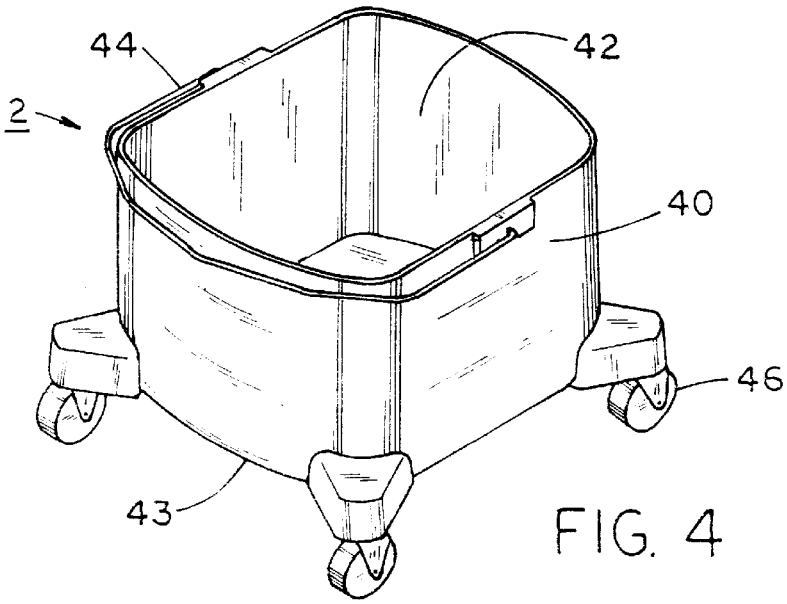
FIG. 4 is a schematic view of the main bucket according to the present invention.
Figure 5:
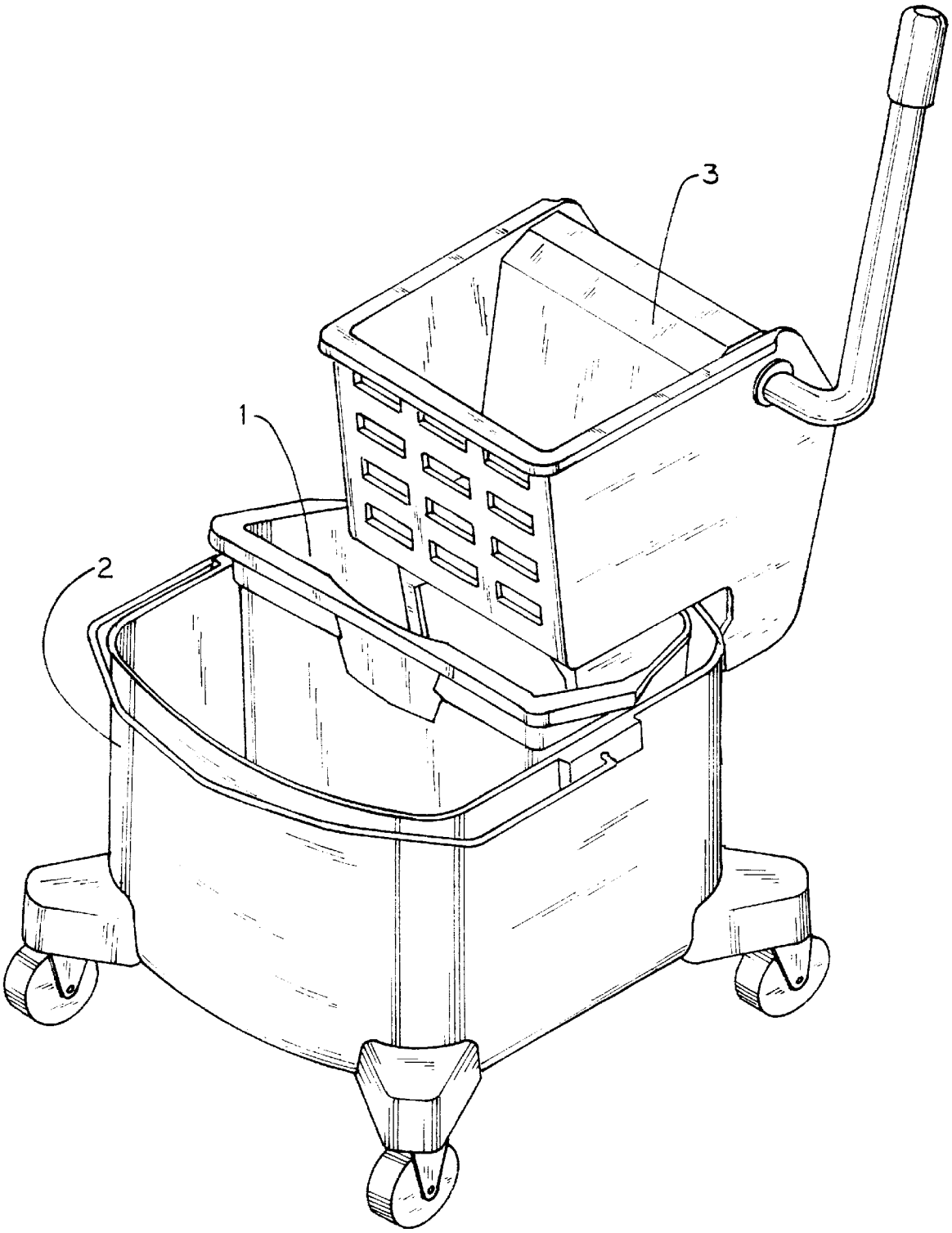
FIG. 5 is an exploded perspective view of the bucket assembly according to the present invention.

Referring to FIGS. 3, 4 and 5, the insert of the present invention is preferably used together with a main bucket and a wringer. Bucket 2 shown in FIG. 4 has side walls 40 and a bottom wall 43 defining a space 42 for containing washing liquid and receiving the insert 1. A handle 44 and wheels 46 are preferably provided for conveniently carrying and moving the bucket. As shown in FIG. 3 wringer 3 has a basket 60 for receiving and wringing dirty mop material, small openings 62 for draining liquid, upper supporting piece 64, and lower supporting piece 66. The upper and lower supporting pieces are used to secure wringer 3 to bucket 2 by inserting wall 40 into the gap 68 formed between lower supporting piece 66 and upper supporting piece 64 on both sides of the wringer 3.

Insert 1 is installed to bucket 2 in such a way that the back wall 12 of the insert 1 is placed against and in touch with one side of wall 40 with side wall 14 close or in touch with two other sides of wall 40. Hook 20 is used to keep the insert 1 in a predetermined position, preferably inside the upper portion of the bucket 2. Once insert 1 is placed in a predetermined position inside bucket 2, wringer 3 can be installed over insert 1 to bucket 2. Side walls 14 in two opposite sides of insert 1 together with corresponding two sides of wall 40 which are close or in touch with walls 14 are inserted into gaps 68 of wringer 3. Gap 68 preferably has a dimension slightly larger than the total thickness of wall 40 and wall 14, so that wringer 3 can be secured to bucket 2 and, in the meantime, the side wall 14 and the back wall 12 of insert 1 are pushed against and forced to fit the shape of the wall 40 of bucket 2 by the supporting piece 66. This forced shape-fitting provides several advantages. One of them is that this makes it possible for the insert 1 to fit a large variety of existing bucket-wringer system because insert 1 is pliable and its exist does not affect the connection between the bucket and the wringer. Another advantage of the combination is that the insert is stabilized by the wringer, so that even the bucket is full of washing liquid the insert still can stay stable without floating around.

The angled and curved designs of side walls 14 and back wall 12 of insert 1 are used to facilitate the confined deformation or shape-fitting. Those designs eliminate sharp turns and dead angles along the walls and, thus, make it easier to fit into different shapes and reduce the chances to damage the insert during such deformation process. Clearly, the material used to build the insert and the thickness of the wall also affect the pliability. Generally, the combination of the material with the wall thickness should be such that the insert can be deformed according to the shape of the bucket, but the insert should be strong and tough enough to hold its basic shape and dirty washing liquid and stay stable inside the bucket. The insert of the present invention is preferably made of synthetic materials. The splash guard 22 of insert 1 has built-in side handles 28 and serves to keep the dirty washing liquid from entering bucket 2 during the wringing process. Handles 28 and indentation 26 provide an easy handling of the insert 1. The dirty washing liquid accumulated in the insert can be dumped by lifting out the insert through handles 28. Because the insert has a light weight, it is very easy to handle. The purpose of the angled bottom wall 16 is to leave more space for bucket 2. Because the bucket 2 usually has a limited volume, the space generated by the inclined surface 17 in the angled bottom wall 16 is valuable to provide a mop with the access to the clean wash liquid in the bottom portion of bucket 2.

Figure 6:
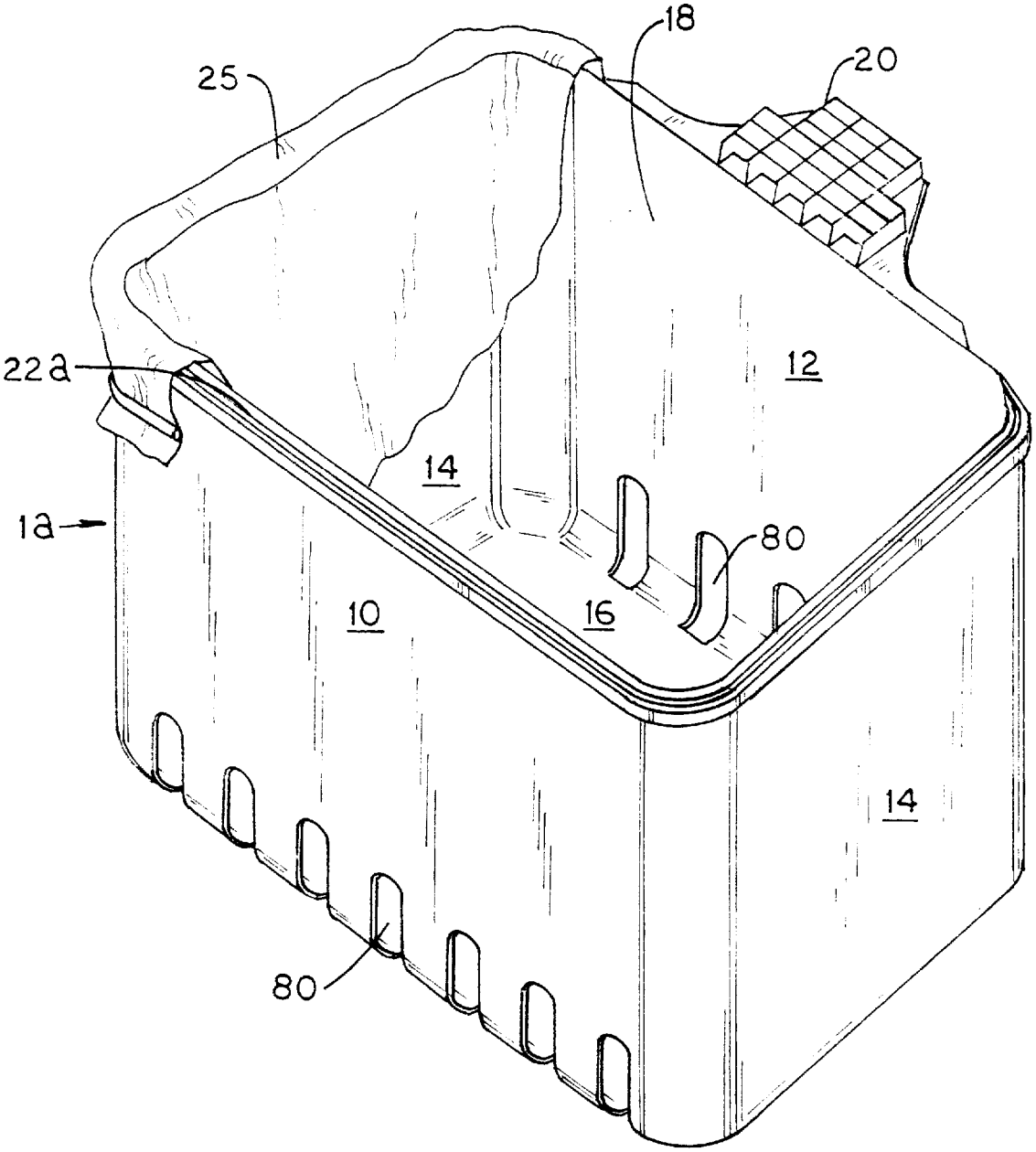
FIG. 6 is a schematic view of the insert according to one embodiment.

FIG. 6 shows an insert 1*a* with holes or openings. Similar to the insert of FIG. 1, the insert 1*a* has a front wall 10, a back wall 12, side walls 14, and a bottom wall 16. Those walls define a space or a chamber 18. On the upper edge of the back wall 12 is a hook 20. There is an upper edge 22*a* on the upper portion of the insert 1, extending one side wall 14 to front wall 10 and then to the other side wall 14. The four comers formed by front wall 10, side wall 14, and back wall 12 are angled. The edge of bottom wall 16 is also angled. A number of holes 80 are provided in bottom wall 16, front wall 10, back wall 12, and side wall 14. In use a flexible plastic bag 25 is put into insert 1*a*. Then insert 1*a* together with the plastic bag is secured to bucket 2 through hook 20 and wringer as described. The upper edge of the plastic bag can be bound to the upper edge 22*a* of insert 1*a*. Thus, the space defined by insert 1*a* is occupied at least partially by the plastic bag. The dirty washing liquid wrung from a mop by wringer 3 is contained and held by the plastic bag. When cleaning is finished or enough dirty washing liquid is accumulated, the plastic bag is taken out, and the dirty washing liquid is drained. The used plastic bag can be reused or disposed.

A cleaning operation according to the present invention usually comprises the following steps: a) filling bucket 2 with washing liquid which usually is water with dissolved detergent; b) installing insert 1 into bucket 2 with the upper edge of the back wall 12 hooked to the upper edge of one side of wall 40; c) installing wringer 3 over insert 1 to bucket 2 by slip-fitting gaps 68 of wringer 3 to the upper edges of side wall 14 and the corresponding side of wall 40, so that both wringer 3 and insert 1 are secured and stabilized onto bucket 2, and that the side wall 14 and back wall 12 of the insert 1 are forced against wall 40 of the bucket by the supporting piece 66; d) dipping a mop into the clean washing liquid contained in the bottom portion of bucket 2; e)

moving the dipped mop over a floor surface; f) inserting the dirty mop into the insert 1 and wringing it with wringer 3, and dirty liquid being drained through openings 62 of the wringer basket 60 to the bottom portion of insert 1; g) repeating steps d) to f).

Based on the above description of the present invention, it is clear that various modifications can be made without departing from the spirit and the scope of the invention.

What is claimed is:

1. A bucket device for separately receiving dirty washing liquid and containing clean washing liquid, comprising:

a bucket having side walls with an upper portion and a bottom wall defining a space for containing clean washing liquid;

an insert pliably mounted inside the upper portion of the space of the bucket, said insert having two side walls, a front wall, a back wall, said side walls, front wall and back wall defining an upper portion and a bottom wall defining a chamber for receiving dirty washing liquid, said bottom wall being upwardly angled at the portion near the front wall forming an inclined surface, said back wall having a hook on said upper portion, the insert further comprising holes on at least one of the bottom wall, the front wall, the back wall, and the side walls; and a wringer having an upper supporting piece and a lower supporting piece forming a gap for receiving the upper portion of the side walls of the bucket and the upper portion of the side wall of the insert so as to secure the wringer onto the bucket over the insert and, in the meantime, the side walls and the back wall of the insert being pushed against the side walls of the bucket by the lower supporting piece to fit the shape of the bucket.

2. The bucket device according to claim 1, wherein the insert further contains a splash guard on the upper portion of the insert covering a whole upper edge of the front wall and part of an upper edge of the side wall.

3. The bucket device according to claim 2, wherein the insert further comprises a spout in the middle of the splash guard on the upper portion of the front wall.

4. The bucket device according to claim 1, wherein the side wall is angled.

5. The bucket device according to claim 1, wherein the bottom wall has an indentation.

6. The bucket device according to claim 1, further comprising two side handles on the upper portion of the side walls.

7. The bucket device according to claim 1, wherein said bottom wall is upwardly angled at the portion near the front wall and forming an inclined surface.

8. A bucket device for separately receiving dirty washing liquid and containing clean washing liquid, comprising:

a bucket having side walls with an upper portion and a bottom wall defining a space for containing clean washing liquid;

an insert pliably mounted inside the upper portion of the space of the bucket, said insert having two side walls, a front wall, a back wall, said side walls, front wall and back wall defining an upper portion and a bottom wall defining a chamber for receiving dirty washing liquid, said bottom wall being upwardly angled at the portion near the front wall forming an inclined surface, said back wall having a hook on said upper portion;

a flexible bag placed in the insert; and a wringer having an upper supporting piece and a lower supporting piece forming a gap for receiving the upper portion of the side walls of the bucket and the upper portion of the side wall of the insert so as to secure the wringer onto the bucket over the insert and, in the meantime, the side walls and the back wall of the insert being pushed against the side walls of the bucket by the lower supporting piece to fit the shape of the bucket.

9. The bucket device according to claim 8, wherein the insert further contains a splash guard on the upper portion of the insert covering a whole upper edge of the front wall and part of an upper edge of the side wall.

10. The bucket device according to claim 9, wherein the insert further contains a spout in the middle of the splash guard on the upper portion of the front wall.

11. The bucket device according to claim 8, wherein the side walls of the insert are angled.

12. The bucket device according to claim 8, wherein the bottom wall of the insert has an indentation.

13. The bucket device according to claim 8, wherein the insert further contains two side handles positioned on the upper portion of the side walls.

* * * * *